United States Patent [19]
Janson
[11] 4,318,252
[45] Mar. 9, 1982

[54] JOIST ASSEMBLY FOR STAGE EQUIPMENT SUPPORT SYSTEM

[76] Inventor: Richard W. Janson, Box 6909, Canton, Ohio 44706

[21] Appl. No.: 111,602

[22] Filed: Jan. 14, 1980

Related U.S. Application Data

[60] Continuation-in-part of Ser. No. 71,586, Aug. 31, 1979, Pat. No. 4,285,095, which is a continuation-in-part of Ser. No. 855,256, Nov. 28, 1977, Pat. No. 4,155,306, which is a continuation of Ser. No. 734,106, Oct. 20, 1976, abandoned, which is a division of Ser. No. 617,508, Sep. 29, 1975, Pat. No. 4,014,071.

[51] Int. Cl.[3] ..... E04C 3/06; E04B 5/55

[52] U.S. Cl. ..... 52/39; 52/639; 52/690

[58] Field of Search ..... 52/639, 641, 690, 693, 52/694, 695, 93, 262, 696, 39, 729, 364, 376

[56] References Cited

U.S. PATENT DOCUMENTS

| | | | |
|---|---|---|---|
| 1,665,782 | 4/1928 | Hanna | 52/690 |
| 1,983,632 | 12/1934 | Miller et al. | 52/694 |
| 3,019,861 | 2/1962 | Rasch | 52/93 |
| 3,214,875 | 11/1965 | Slowinski | 52/729 |
| 3,719,818 | 3/1973 | Porter | 248/317 |
| 4,034,957 | 7/1977 | Cody | 52/729 |
| 4,106,256 | 8/1978 | Cody | 52/694 |

FOREIGN PATENT DOCUMENTS

| | | | |
|---|---|---|---|
| 164286 | 12/1933 | Switzerland | 52/691 |
| 650239 | 2/1951 | United Kingdom | 52/710 |

*Primary Examiner*—John E. Murtagh
*Attorney, Agent, or Firm*—Penrose Lucas Albright

[57] ABSTRACT

A joist or truss assembly adapted for supporting a grid system which is installed under a stage ceiling combined with supporting columns. The truss has a number of vertically disposed diaphragms which are received and bolted rigidly to upper and lower chords to form the truss. The upper chord has two spaced-apart arms extending upwardly and outwardly from an upper aspect of its central connection portion and which define between them an upper groove which has a vertical cross-section configuration of an upright "T". The upper portions of the chord's arms are horizontal, extending both outwardly and inwardly, to define a slot which provides access centrally into the groove. The lower chord is identical to the upper chord but is rigidly connected to the diaphragms in an inverted condition whereby it exposes at its bottom a lower groove having a vertical cross-section configuraton of an inverted "T". This lower groove including the entry slot as well as the upper groove, is cruciform-shaped as seen in cross-section and is adapted to receive other cruciform-shaped parts of underlying components. The grid system is normally secured in place from the overhead truss by hanger rods through support members having a horizontal flange and a support part of cruciform-shaped cross-section to mate with and be received slideably within the cruciform-shaped groove defined at the bottom of the truss. The bottom of the truss is adapted to receive chain links in its cruciform-shaped groove for supporting depending chains either for safety purposes or for support of underlying elements.

11 Claims, 33 Drawing Figures

FIG. 1
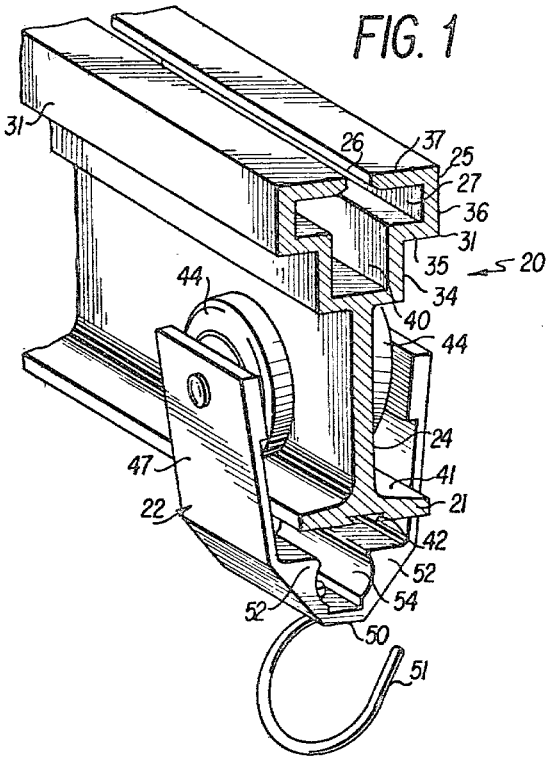
FIG. 1A
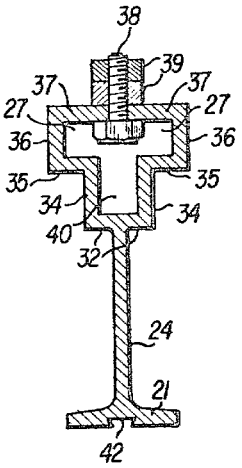
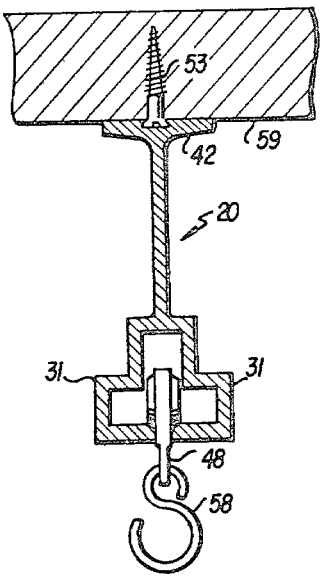
FIG. 1B
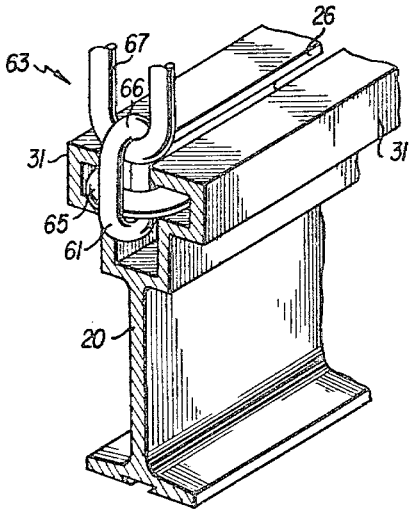
FIG. 2

FIG. 26
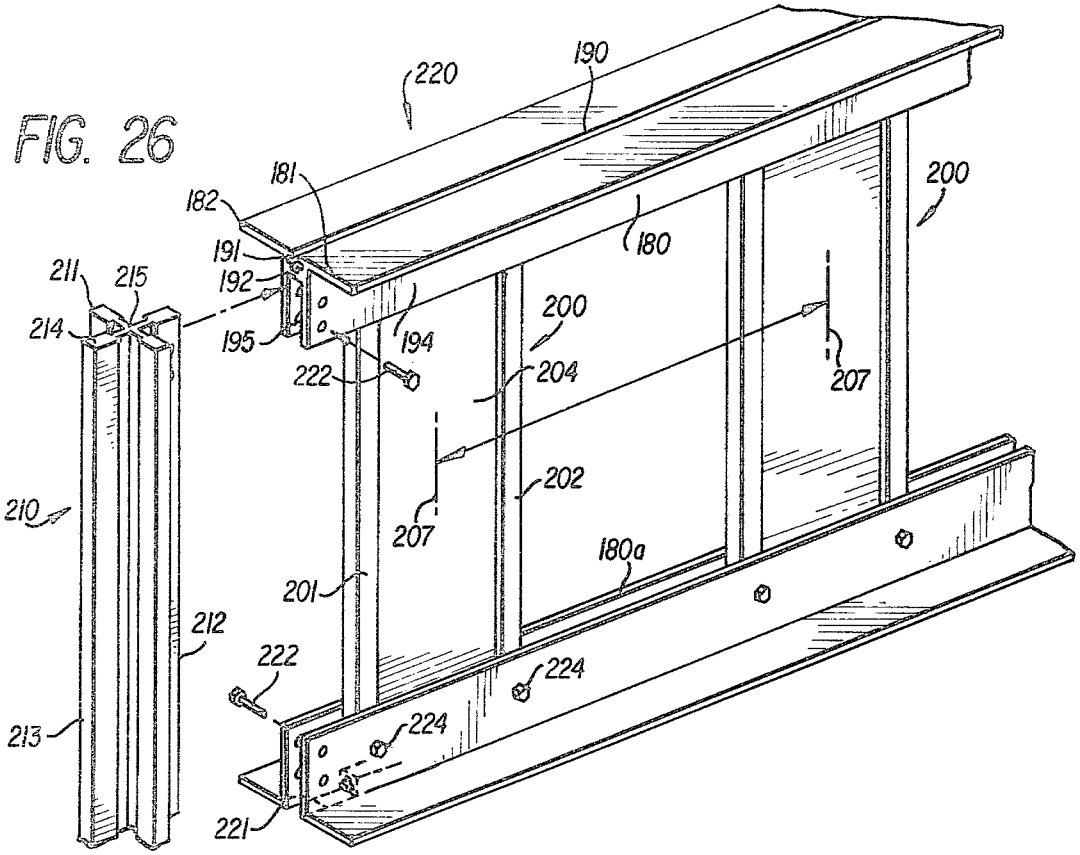
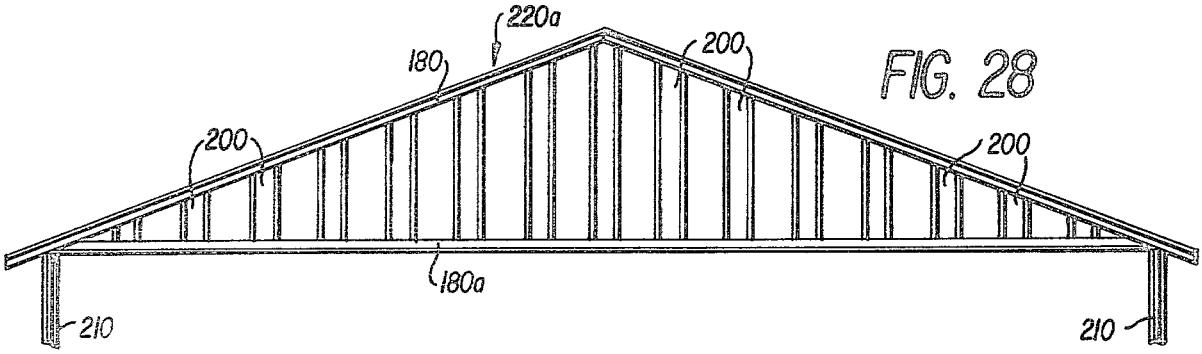
FIG. 28
FIG. 29
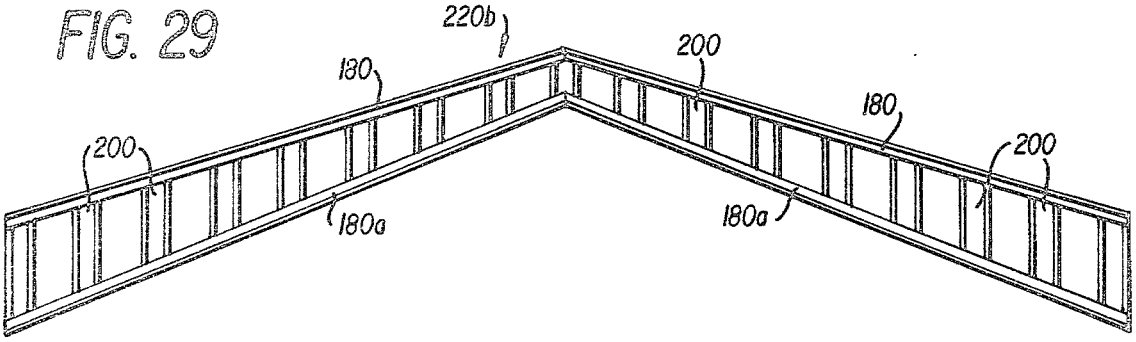

JOIST ASSEMBLY FOR STAGE EQUIPMENT SUPPORT SYSTEM

RELATED APPLICATIONS

This is a continuation-in-part application of my application, Ser. No. 071,586, filed Aug. 31, 1979, now U.S. Pat. No. 4,285,095, which is a continuation-in-part of application Ser. No. 855,256, filed Nov. 28, 1977, issued as U.S. Pat. No. 4,166,306, Sept. 4, 1979, which is a continuation of application Ser. No. 734,106, filed Oct. 20, 1976, now abandoned, which is a divisional application of application Ser. No. 617,508 filed Sept. 29, 1975, issuing Mar. 29, 1977, as U.S. Pat. No. 4,014,071.

BACKGROUND OF THE INVENTION

Various types of metal joists or trusses for buildings wherein the overhead structure provides support for curtain suspension systems and other equipment are available commercially and known in the prior art. An increasing problem exists in the installation of stage equipment and curtain suspension assemblies—particularly the larger heavy-duty assemblages—in the labor costs of installing same. Thus, as the systems become more complicated, time required for installation and the level of skill required increases. It has occurred to the inventor that this problem may be solved through designing and manufacturing complete suspension systems including the overhead joists at the plant as relatively simplified units which can be installed without the necessity of complicated or involved construction procedures and which at the same time are adaptable to a wide variety of architectural arrangements which may be encountered particularly in commercial and public establishments.

SUMMARY OF THE INVENTION

The invention relates to joist or truss assemblies particularly adapted for curtain suspension systems and to components for the trusses and supporting columns in various combinations. More particularly, the invention relates to such an assembly and components combined therewith which are adapted for heavy-duty use such as for supporting curtain suspension assemblies in theaters and the like wherein the design and cooperation of the components of the system facilitate its installation and the system is thus easily installed and provides numerous types of overhead constructions which may be desired.

Various components which may be used in combination with the invention include a suspension system for stage equipment, a curtain rod which has flanges in its lower portion to receive curtain rod carriers and defines a cruciform-shaped groove of constant cross-section in its upper portion to receive a mating, like shaped part of an upper support or other component which, in turn, is connected with a strut which depends from a truss in accordance with the invention. The cruciform-shaped groove in the bottom of the truss may cooperate with an appropriately dimensioned link chain whereby the strut or rod can be connected to such truss either to provide supplemental support or for safety purposes. Various supports which include a cruciform-shaped part for being received in the groove are adapted to cooperate with angle clips, gripping devices, bolts of various types and the like to provide considerable adaptability and flexibility in supporting and securing underlying components from the overhead truss structure at the installation site.

Trusses in accordance with the invention can be assembled at the building site or in the field conveniently with hand tools limited, if necessary, to a portable band saw, a portable electric drill and a measuring rule. In the event that the component parts of the assembly are earlier cut to size at the plant or factory, only a portable drill may be necessary. It is also noted that with the diaphragms of the truss properly cut at the factory or plant, squaring tools are not required at the building site. The assembly can be erected rapidly. It is also important to understand that the truss which constitutes an assemblage in accordance with the invention can be strengthened by several methods. One is to affix rigidly to the chords, the diaphragms on closer centers. Another is to bolt a support member to the upper chord or to the lower chord or to both. Generally, for installation of the trusses in accordance with the invention, it is desirable to reduce the weight of components to less than two hundred fifty pounds and this generally can be accomplished by erecting first the top chord which is rested (and usually secured) on at least one leg edge of the cruciform-shaped column. Thereafter, the diaphragms can be bolted rigidly to the upper chord and, in turn, are bolted to the lower chord. Through this means, the trusses may be positioned at their permanent place in the building without cranes or hoists by only three or four men working together.

From the foregoing, it will be understood by those skilled in the art that an important and primary object of the instant invention is a truss assembly and supporting structure which is particularly advantageous for supporting stage equipment and which is constituted of components which are preferably manufactured of extruded structural aluminum or other extruded structural material. However, other objects, adaptabilities and capabilities of the invention will be appreciated by those skilled in the art as the description progresses, reference being had to the accompanying drawings in which:

BRIEF DESCRIPTION OF THE DRAWINGS

FIG. 1 is a perspective view of a first embodiment of a component of the invention showing the curtain rod and a curtain carrier thereon;

FIG. 1A illustrates the incorporation of limiting means in the curtain rod;

FIG. 1B shows the curtain rod in an inverted mode;

FIG. 2 is a perspective view of the curtain rod shown in FIG. 1 with a link chain extending from its slot;

FIG. 26 is a perspective broken view of the truss assembly supported and connected to a cruciform-shaped column;

FIG. 28 illustrates a modified embodiment of the truss assembly; and

FIG. 29 illustrates a further modified embodiment of the truss assembly in accordance with the invention.

DESCRIPTION OF THE PREFERRED EMBODIMENTS

Figure 3:
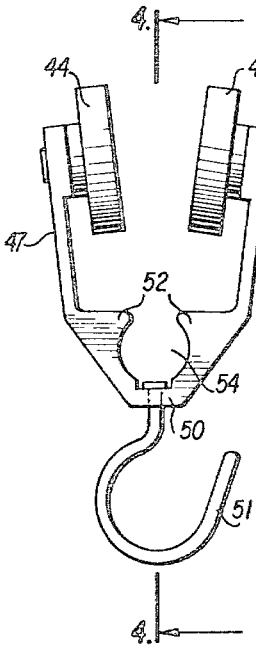
FIG. 3 is an elevational detail view of the carrier shown in FIG. 1.

Referring to FIG. 1, a curtain track or rod 20 is shown which supports on its lower flange 21 a plurality of curtain carriers such as carrier 22. Rod 20 comprises a vertical part 24 which extends upwardly normally from flange 21 to the upper portion 25 which defines a slot 26 in groove 27 for receiving a rod support 30 as shown, for example, in FIG. 5. Upper portion 25 comprises a pair of arms 31 which, as seen in cross-section are mirror images, one of the other, each including first a horizontal extension 32, next a second vertical extension 34, then a third further horizontal extension 35, and next a fourth further vertical extension 36, each arm 31 then extending inwardly to define slot 26, thus terminating with a fifth still further horizontal extension 37. Arms 31 define a cruciform-shaped space as seen in cross-section which comprises upper slot 26, grooves 27 on either side and a lower recess 40 between vertical part 24 and slot 26. In the lower portion 41 of rod 20, flange 21 may be provided with a bottom groove 42 which is broader in its upper inner aspect than at its lower aspect.

In FIG. 1A, a stop or limiting means is provided which comprises a bolt 38 which has its head within the grooves 27 and its threaded shank extends upwardly through slot 26 wherein it is threadably received by a pair of nuts 39.

As shown in FIG. 1B, by inverting rod 20, it may be utilized for a less expensive curtain track for a lighter curtain or drapes wherein the space defined by arms 31 receives a plurality of movable supporting members 48 which are each provided with a depending hanger portion 58, such supporting member 48 conforming to a structural device disclosed in U.S. Pat. No. 3,076,222 to P. H. Sloan of Feb. 5, 1973. The recess 42 is utilized to support rod 20 by a plurality of flat head screws 53 received and aligned in a ceiling member 59.

Figure 4:
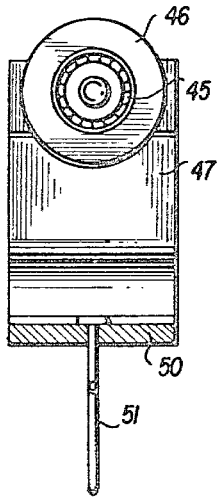
FIG. 4 is a sectional view of the carrier shown in FIG. 3 on section lines 3—3 of such Figure.
Figure 18:
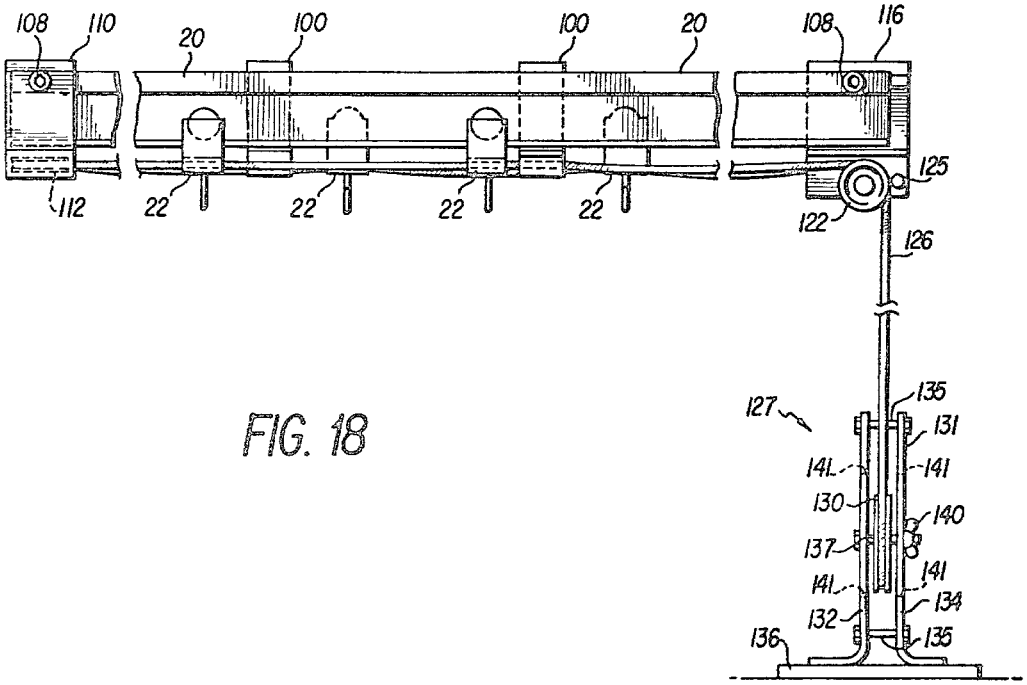
FIG. 18 is an elevational broken view which illustrates cooperation of various components of the curtain suspension assembly.
Figure 19:
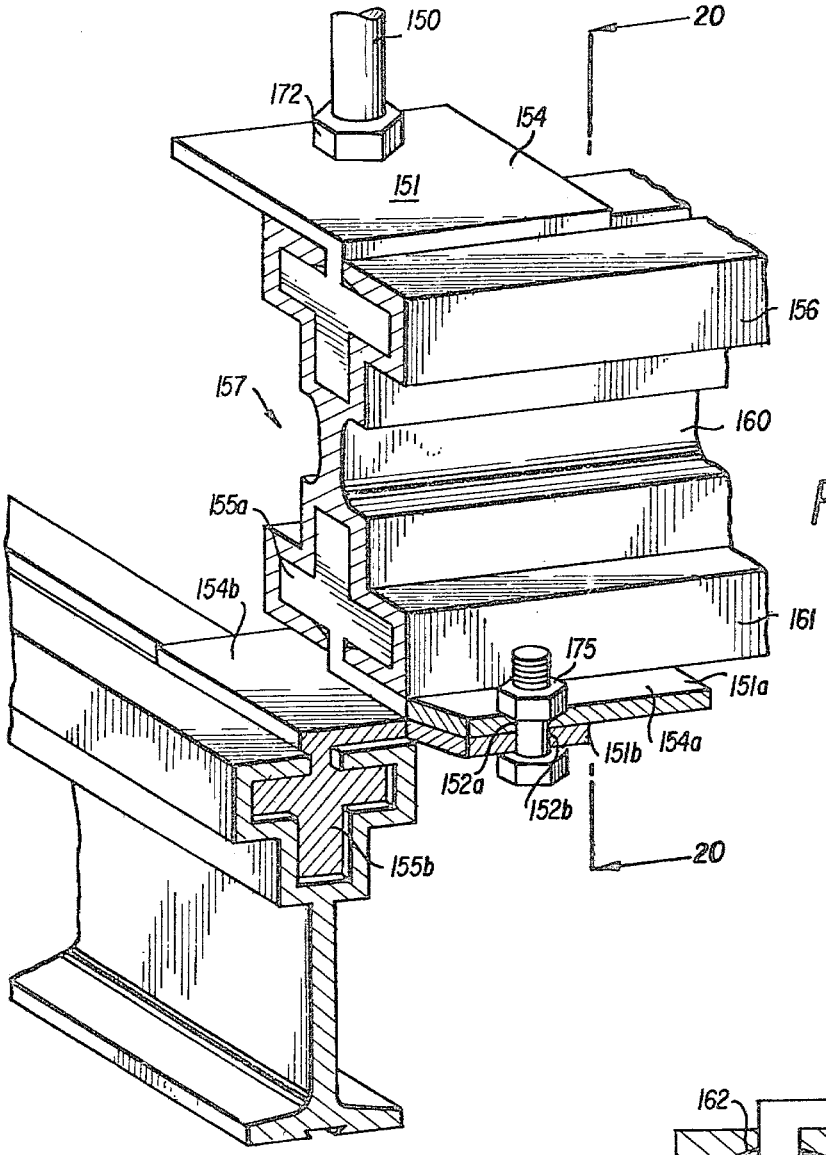
FIG. 19 is a perspective view of a strut which is suspended from overhead structure in accordance with the invention and which in turn suspends a curtain rod with curtain carriers thereon, the strut, support members and the curtain rod being shown in partial section.

Curtain carriers 22 as shown in FIGS. 1, 3 and 4 incorporate two wheels 44, each such wheel having a race of ballbearings 45 and equipped with rubber or neoprene tires 46 for silent operation. Each wheel 44 is journalled to an arm member 47. The lower part of each arm member 47 joins and is integral with a horizontal member 50 which carries a depending curtain hook 51. Each arm member 47 also includes a thicker profiled part 52 which defines a horizontal cylindrical opening 54 for frictionally receiving the curtain rope 126 (FIG. 18).

Figure 5:
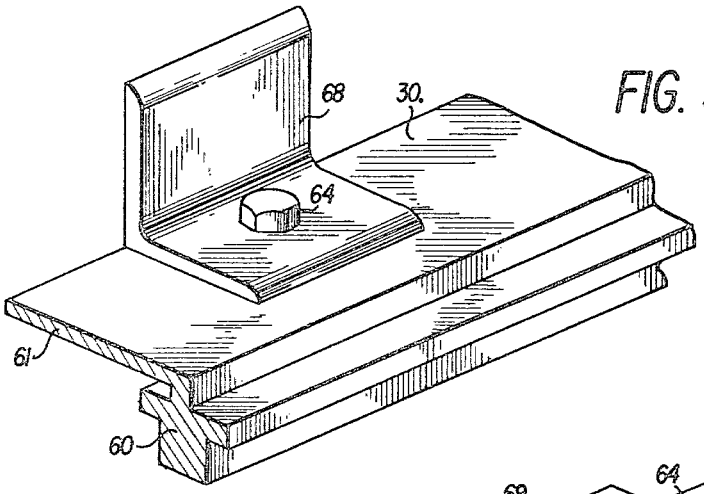
FIG. 5 is a perspective view of a rod support bolted to an angle clip.
Figure 6:
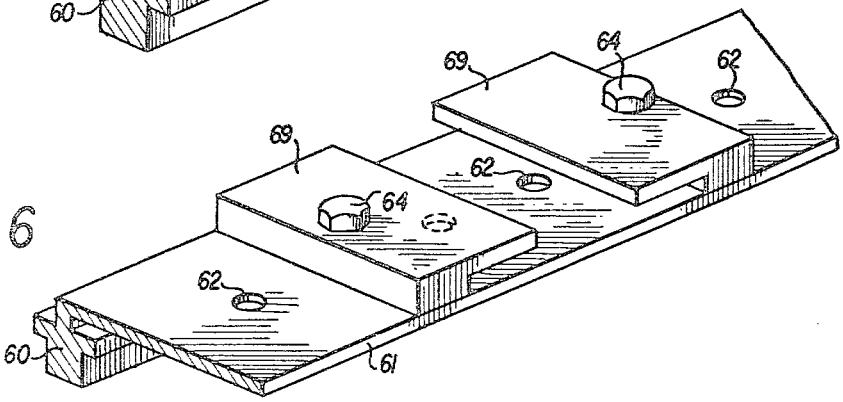
FIG. 6 is a perspective view of a rod support with cross-beam clamps bolted thereto.
Figure 8:
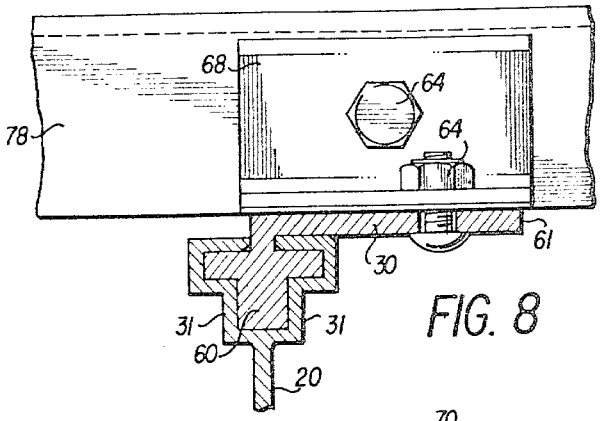
FIG. 8 is a broken view illustrating an angle clip similar to that shown in FIG. 5 together with the rod support and curtain rod.

Each rod support 30, as seen in FIGS. 5 and 8, includes a support part 60 of cruciform-shaped cross-section so as to mate with and be received slideably within the cruciform-shaped space defined by arms 31 of rod 20. Rod support 30 also comprises a horizontal flange member 61 extending in one direction from the top of part 60 and integral therewith. As illustrated in FIG. 6, flange member 61 may be provided with one or more openings 62 to receive bolts 64 or the like whereby support 30 may be connected to the lower flanges of I-beams of various sizes by cross-beam clamps 69 or via angle clip 68, to an overhead beam 78 as shown in FIG. 8.

Figure 7:
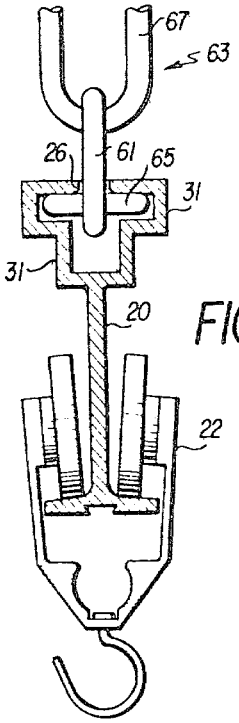
FIG. 7 is an elevational view showing a curtain rod supported by a link chain with a carrier.
Figure 27:
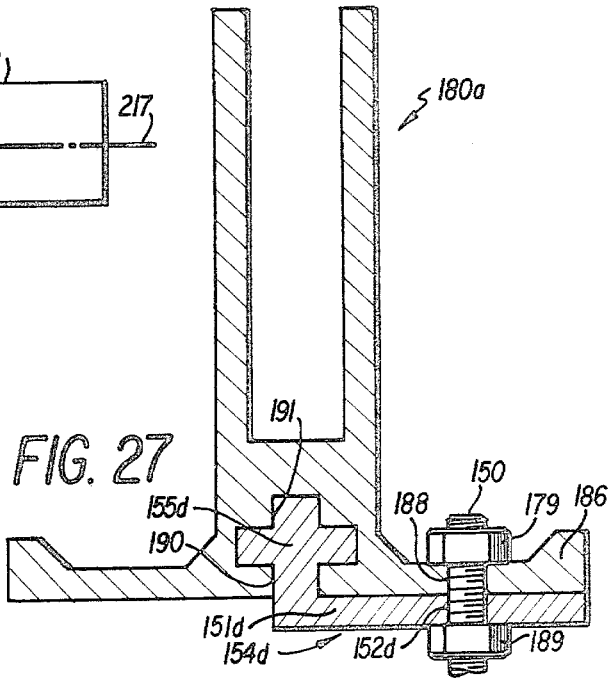
FIG. 27 is a cross-sectional view of a lower chord member of the truss assembly.

With particular reference to FIGS. 2 and 7, a link chain 63 may be provided for support at any point along rod 20 without the necessity of utilizing drills or other tools or bolts. This is accomplished by inserting the bottom or lower link 65 into the cruciform-shaped space defined by arms 31 with the next to last link 66 extending through the slot 26 in a vertical disposition. The next higher link 67 and other links also hang vertically. Accordingly, with an appropriate dimensioned link chain 63, rod 20 may, if desired, be supported by such link chain, inverted in the sense of FIGS. 2 and 7, depending, for example, from slot 190 and groove 191 of truss **180*a* as shown in FIGS. 26 and 27, without the necessity of drilling holes or using nuts and bolts. Moreover, the link chain 63 may be slipped along the slot 26 until under an overhead beam or other structured member, for example, a truss 180*a* or a strut 157, and secured in groove 170 or 191 or otherwise as seen in FIGS. 19–22, to support, at least in part, the curtain rod 20 at the desired height. Alternatively, the link chain 63 may be used effectively and with minimal expense in conjunction with primary supporting components such as trusses 180***a* to provide secondary supporting or safety structure should the primary support fail.

Figure 9:
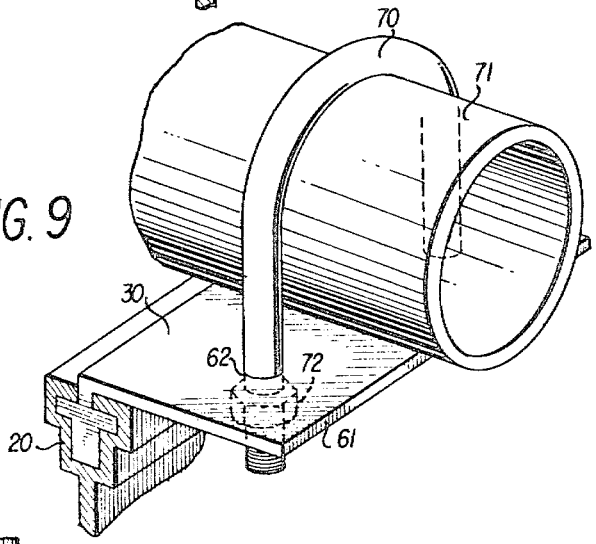
FIG. 9 is a perspective view illustrating a rod support as shown in FIG. 5 connected to an overhead pipe.

FIG. 9 illustrates a rod 20 supported by a rod support 30 which in turn has its flange member 61 connected to a pipe 71 by means of a U-bolt 70 received through a pair of openings 62 with lower threaded portions of U-bolt 70 receiving a pair of nuts 72 (only one being shown). The extrusion which constitutes support 30 and flange member 61 may be severed at an angle other than 90° relative to rod 20.

Figure 10:
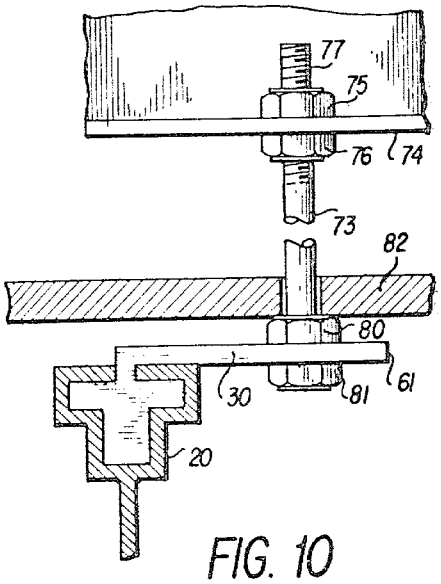
FIG. 10 is an elevational view illustrating means to suspend a rod support as shown in FIG. 5 under a suspended ceiling.

In FIG. 10, means for attaching the rod support 30 to a suspended ceiling 82 is disclosed. Here a bolt 73 is secured directly to an overhead bottom flange 74 of a steel roof member by nuts 75 and 76 received on the threaded end portion 77 of bolt 73. Flange member 61 receives the lower end of bolt 73 through an opening 62 and is secured thereto by means of nuts 80 and 81 in a manner whereby nut 80 performs the further function of contributing to the support of the suspended ceiling 82. Through this arrangement hangers or bolts 73 position rod support 30 immediately below the suspended ceiling 82.

Figure 11:
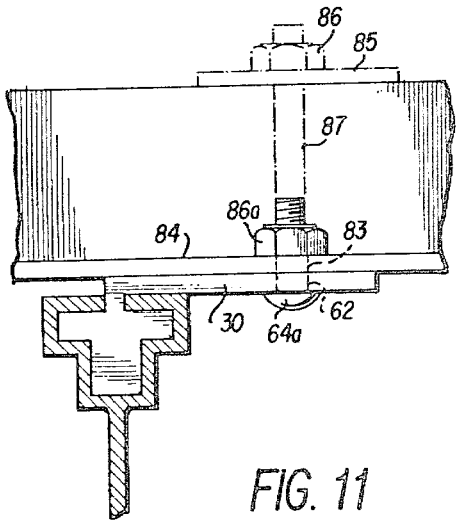
FIG. 11 is an elevational view illustrating connection of a rod support shown in FIG. 5 to the bottom chord of joists.

In FIG. 11, rod support 30 is fastened directly to the bottom of an exposed steel flange 84 or, if the bottom chord of the joist comprises angles situated back-to-back with a space between, longer fully threaded bolts 87, as indicated in dot-dash lines, are used with a heavy washer 85 to bridge such joists which are situated back-to-back, the heavy washer 85 being held in place by means of a nut 86. In fastening rod support 30 directly to the bottom of steel flange 84, a short threaded bolt 64*a* is employed through the opening 62 and a further opening 83 in flange 84. A nut 86*a* is received by bolt 87 which is tightened against flange 84 as shown in FIG. 11.

Figure 12:
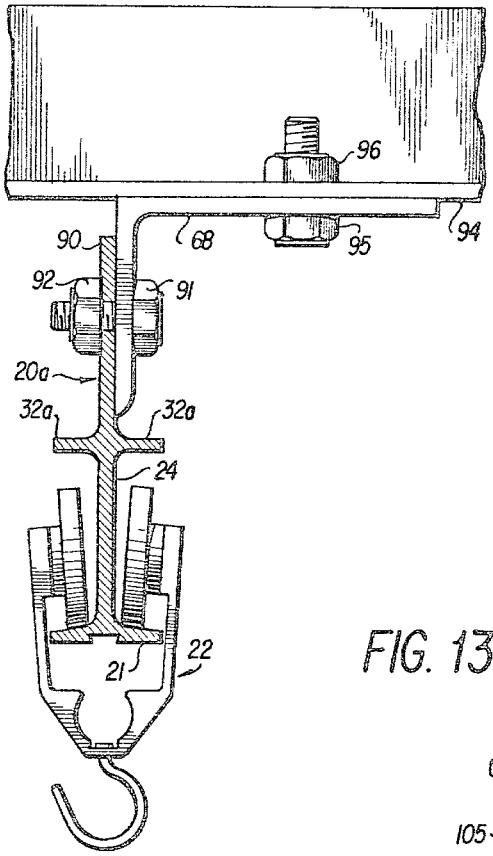
FIG. 12 is an elevational view of a modified curtain rod with a carrier thereon which is connected directly by means of an angle clip to the bottom chord of an overhead joist.

In FIG. 12 a modified rod 20*a* is shown which is similar to rod 20 in that it includes a vertical part 24 and a lower flange 21 which supports curtain carriers 22. It also includes a pair of oppositely extending horizontal extensions 23*a*, but instead of having arms 31, a single vertical plate part 90 is provided which is bolted to an angle clip 68 and by means of bolt 91 and nut 92 as shown in FIG. 12. Angle clip 68, in turn, is bolted to the bottom flange of an overhead I-beam by means of bolt 95 and nut 96.

Figure 13:
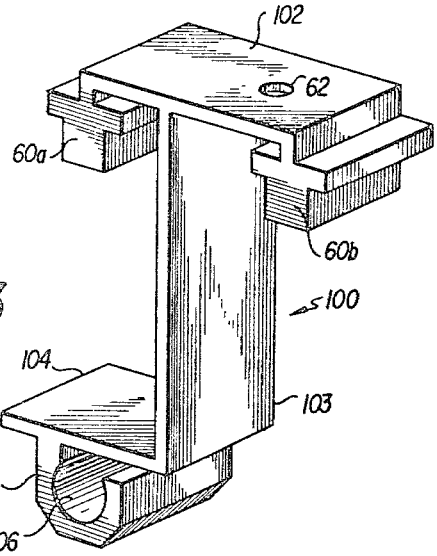
FIG. 13 is a perspective view of a combination lapping spacer, rod support, carrier bumper and rope holder.
Figure 14:
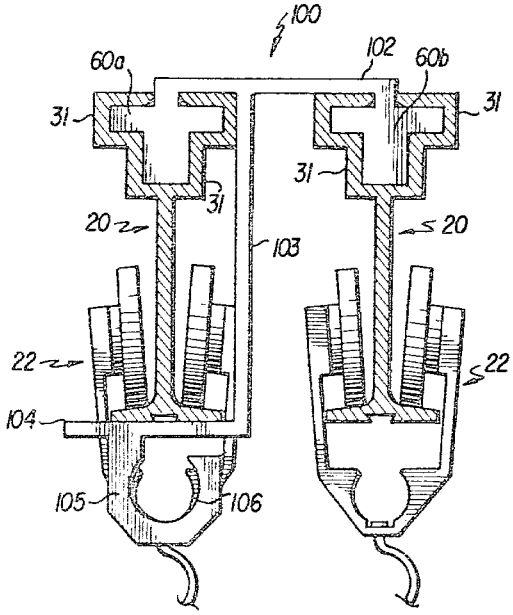
FIG. 14 is an elevational view of the spacer shown in FIG. 13 supporting a pair of curtain rods with a carrier shown on each.

In FIGS. 13 and 14, a lapping spacer designated generally by reference numeral 100 is illustrated. Spacer 100 performs the different functions of being a lapping spacer for overlapping rods at the midway curtain overlap, a carrier for such rods and a rope holder or support for the rope utilized for moving the curtains and located at the midlap of overlapping curtains or drapery. In this connection it will be understood that normally two curtain rods 20 are provided which are separated to permit the two curtain sections to overlap in the central location of the area served by the curtains. The spacing function of the spacer 100 is served by the upper part which comprises a flat plate portion 102 with depending cruciform-shaped support parts 60*a* and 60*b* at the edges thereof, such parts 60*a* and 60*b* being so configured to be slideably received in the spaces comprising slots 26, grooves 27 and recesses 40 of curtain rods 20 and therefore are, in this sense, identical to part 60. Extending downwardly from plate portion 102 between support parts 60*a* and 60*b* is a bumper part 103 which includes a horizontal leg 104. A rope guide 105 extends downwardly from leg 104 to hook around and partly surround a cylindrically-shaped horizontally disposed guide space 106 which receives the rope in a slideable fashion for moving the curtains and provides support for same. Leg 104, together with guide 105 perform the bumper function of spacer 100 and rope guide 105 functions, approximately in the upper central part of the stage to support rope for moving the curtains. Thus, the rope is supported at about the middle of the complete track to minimize the sagging.

Figure 15:
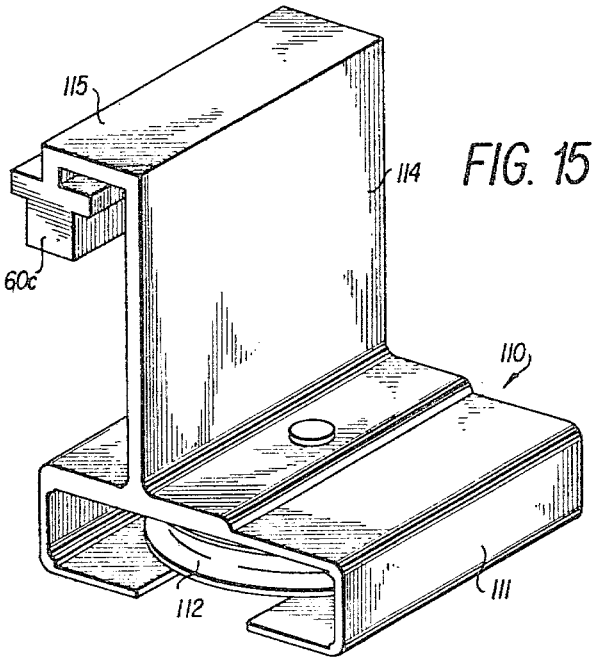
FIG. 15 is a perspective view of a combination deadend pulley and rod supports.

In FIG. 15, a single-end pulley also known as a deadend pulley member 110 is shown which comprises a housing 111 which carries the pulley 112 and has extending upwardly therefrom a vertical plate 114 which integrally connects to a horizontal plate 115. Depending from the plate 115 is a cruciform-shaped member 60*c*, which, identical to parts 60, 60*a* and 60*b*, is configured to be received by the space defined by slot 26, grooves 27 and recess 40 of curtain rod 20. By then affixing part 60*c* relative to rod 20 by a bolt 38 or set screw 108 (See FIG. 13), pulley 112 is automatically aligned in its desired location relative to rods 20 and carriers 22 for overlapping curtains carried by carriers 22. The same is true with reference to the double-end pulley known as a live-end pulley member 116 shown in FIG. 17. It will be understood that the live-end pulley member 116 includes a bracket 117, a cover plate 120 and, identical to the deadend pulley member 110, a vertical plate 114, horizontal plate 115 and support part 60*c*. An axle 121 rotatably carries a pair of pulleys 122 which are secured relative to vertical plate 114 by a nut (not shown). A pair of rotatable keepers 125 are also bolted to the bracket 117 which serve the purpose of maintaining rope 126 within the pulleys 122.

Figure 15A:
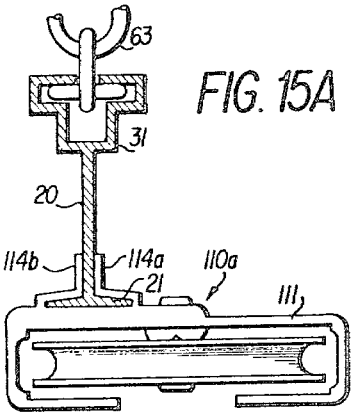
FIG. 15A is an elevational view of a rod supported deadend pulley.

FIG. 15A shows in elevational view an alternative embodiment of a deadend pulley member which is designated 110*a*. Here it will be noted that housing 111 is provided with a pair of upstanding profiled plates 114*a* and 114*b* which receive flange 21 of rod 20 which in turn is supported by link chain 63 received in the space defined by arms 31 as previously explained.

Figure 16:
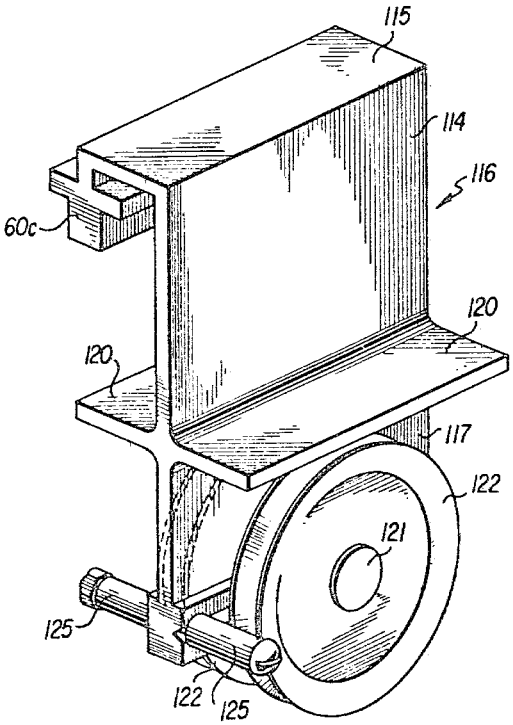
FIG. 16 is a perspective view of a combination live-end pulley and rod support.
Figure 16A:
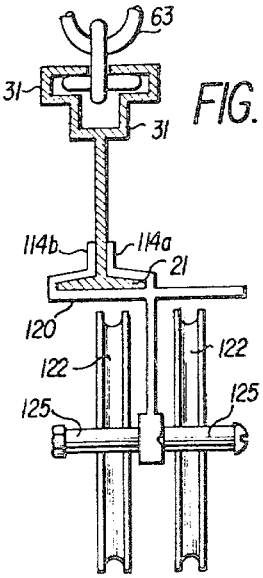
FIG. 16A is an elevational view of a rod supported live-end pulley.

In the embodiment of FIG. 16A of a modified live-end pulley, similar profiled plates 114*a* and 114*b* are provided so as to be connected to and integral with cover part 120 which, as shown in FIG. 16A, are configured to receive flange 21 of rod 20 which, in turn, is supported by link chain 63 received in a space between arms 31 as previously explained and shown in more detail in FIG. 2. Again, either pulley member 110*a* or 116*a* as shown in FIGS. 15A and 16A may be affixed to a rod 20 by means of a set screw, bolt or other suitable means. Also, again, each pulley device is automatically located relative to rod 20 and carrier 22 through the arrangement disclosed.

Figure 17:
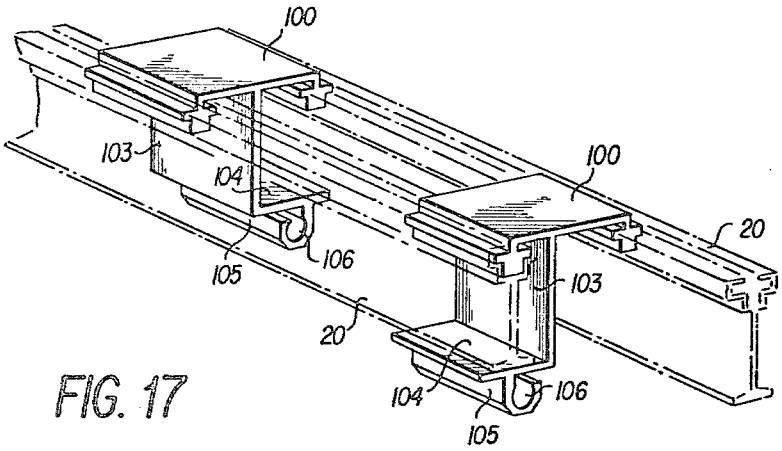
FIG. 17 is a perspective view illustrating the utilization of a pair of lapping spacers as shown in FIGS. 13 and 14 within the curtain suspension system.

FIGS. 17 and 18 disclose the assembly whereby the cooperation of various components may be more readily understood. In FIG. 17, the disposition of a pair of spacers 100 relative to overlapping rods 20 (shown in dot-dash lines) at the midway curtain overlap is shown.

In FIG. 18, an assembly is shown including the endless rope 126 and a floor pulley member 127 which includes a pulley 130 held in a housing 131 comprised of a pair of spaced plates 132 and 134 held in alignment by spacing bolts 135, plates 132 and 134 being affixed to a bottom plate 136 which is secured to the deck. Pulley 130 is supported by an axle 137 which is held in its desired vertical disposition by a wing nut 140 within vertically disposed slots 141 whereby the height of the pulley 180 is vertically adjustable relative to the housing 131.

Referring to FIGS. 17 and 18, it will be noted that a pair of overlapping rods 20 are in part supported and held the desired distance apart by means of spacers 100 which also function to prevent carriers 22 from moving off of the respective rods 20. A rope 126 for opening and closing the curtain carried by carriers 22 is received in an endless manner about the pulley 112 into space 54 of each carrier 22 wherein it is frictionally received and secured and causes the carriers 22 therefore to move with it. Rope 126 extends through guide space 106 in rope guide 105 through which it easily slides, to the live-end pulley 122 and finally to and around the floor pulley 130. Thus by causing rope 126 to be moved to one direction or the other, carriers 22 together with curtains suspended therefrom are caused to move so that the curtain is either opened or closed and, upon closing, overlaps a distance as defined longitudinally between the spacers 100.

The components of the assembly such as rods 20 and 20*a*, rod supports 30, angle clip 68, I-beam clamps 69, spacers 100, pulley members 110, 110*a*, 116 and 116*a*, are, insofar as practicable, extruded aluminum. The drawings are approximately proportional to the actual components used. As a measure of comparison, rod 20 is about 6.6 cm in height and 3.5 cm in width across arm 31 and 3.0 cm across flange 21. Size is important to cost of manufacture as well as to strength and weight of the components.

Referring to FIGS. 19–22, hanger rods 150 are installed prior to the ceiling installation whereby they depend from positive connections to the structural members above the ceiling such as trusses 220 which will be described subsequently in more detail. The ceiling may be an inexpensive tilt-out ceiling system over the stage area which are frequently installed because they provide increased safety in the event of fire. Hangers 150 are threaded throughout their length and receive a first support member 151 through an opening 152 in the horizontal flange part of member 151. Depending and integral with flange part 154 opposite opening 152, is a cruciform-shaped portion 155 which is received in the matching cruciform-shaped groove 162 of upper portion 156 of strut 157.

It is to be observed that strut 157 has an I-beam central portion 160 which is integral with and connects with the upper portion 156 and an identical but oppositely extending lower portion 161. Cruciform-shaped groove 162 of the upper portion 156 is defined by a pair of arms 164 and 165 which extend from the upper flanges of the I-beam portion 160. In a similar manner, a pair of lower arms 166 and 167 define a cruciform-shaped groove 170 at the lower aspect of strut 157. A second support member 151*a* has a cruciform-shaped portion 155*a* which is received in the slot 170. Opening 152*a* in support member 151*a* receives a bolt 171. The upper support member 151 is retained firmly in position relative to the hanger 150 by a pair of nuts 172 and 174 which are tightened firmly against flange part 154. Bolt 171 and nut 175 are used to connect to a third support member 151*b* which is received within slot 26 of rod 20. Thus, it will be appreciated that rod 20 is supported by hanger 150 which connects to the upper first support member 151, through the strut 157 to the lower second support member 151*a* and finally through the further third support member 151*b*. The support members 151, 151*a* and 151*b* have the same cross-section but they may be of differing lengths, as desired.

Figure 21:
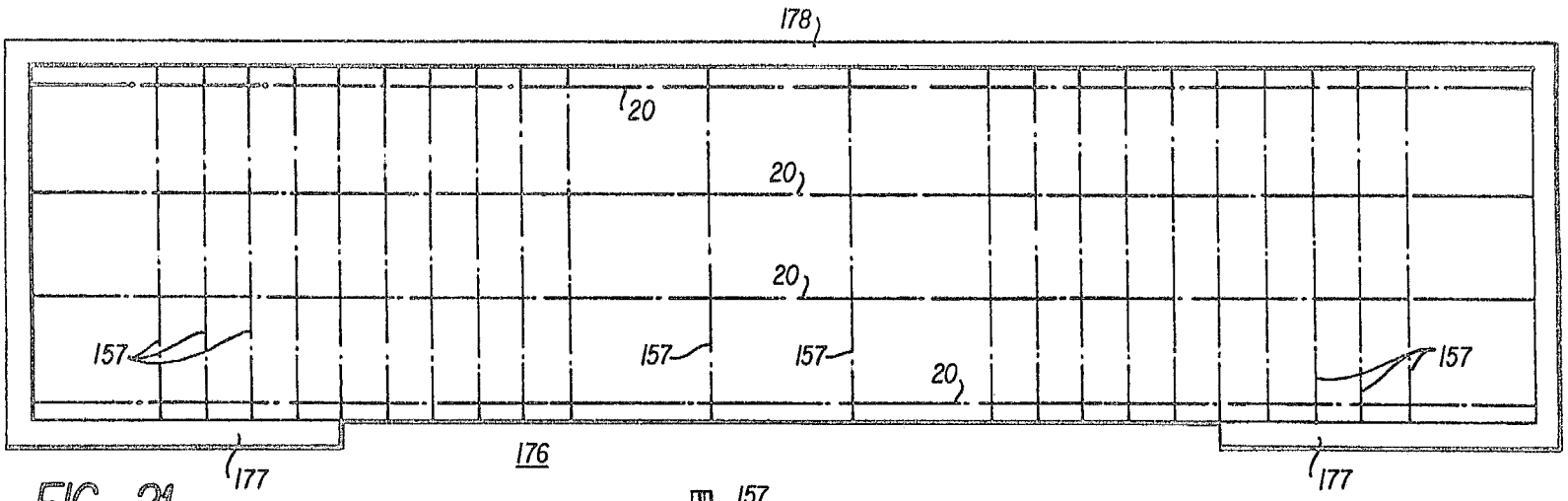
FIG. 21 is a diagrammatic illustration of an installed stage equipment support strut system.
Figure 22:
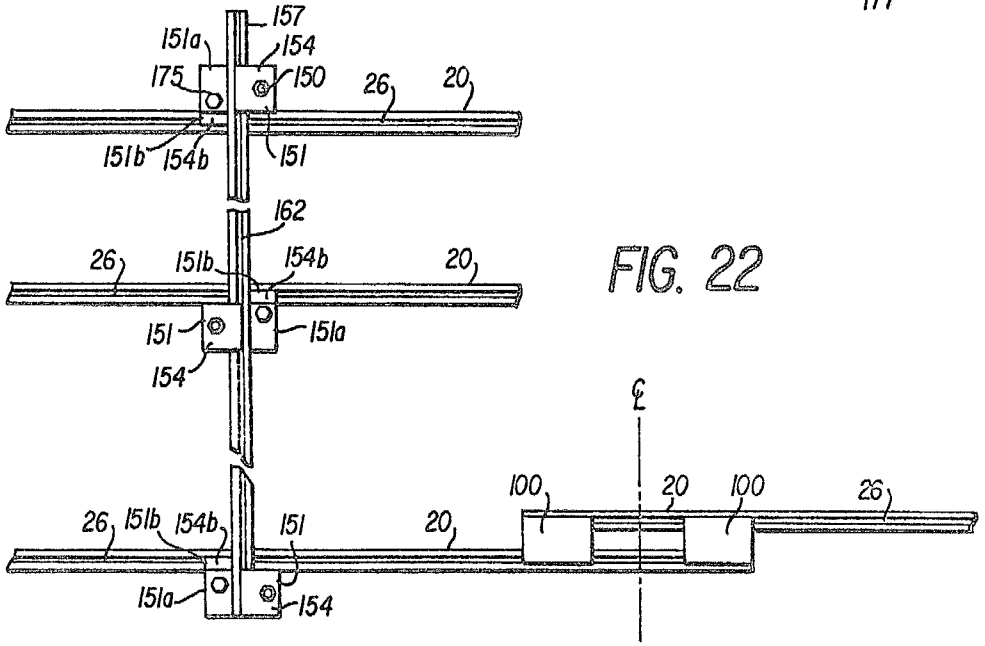
FIG. 22 is a broken detail view of the system of FIG. 21 showing in plan connections between a strut and curtain rods.

As seen in FIG. 21, the proscenium opening 176 lies between the stage walls 177 and the strut-channel system shown in FIG. 21 below the ceiling comprises parallel rows of struts 157, perpendicular to the plane of the proscenium opening 176, extending for the full depth of the stage from the proscenium opening plane to the rear stage wall 178. It will be noted that the central four struts 157 are separated apart about three times the distance between struts 157 on both sides of such center portion. In practice, these distances are six feet and two feet, respectively. Four rods 20 are shown which extend parallel to the proscenium opening plane. However, it is to be understood that these rods 20 each comprise, in fact, two rods which are joined at the center by spacers 100 in a manner as shown in FIGS. 17 and 22. Otherwise, the curtains would be drawn together without any overlap.

Support members 151 may be, and preferably are, spaced to extend alternately relative to the strut 157 as shown in FIG. 22 and the same is true insofar as the further support members 151*a* and 151*b* are concerned. By this means, the strength of the system is, to a certain degree, increased. Rods 20 are installed whereby their flanges 21 are a height greater than the vertical dimensions of the proscenium opening—say about one yard.

An advantage of struts 157 aside from their strength is that, being extruded aluminum, they do not require painting or cladding as a protective coating. Nevertheless, their strength is sufficient whereby they may be used in lieu of known steel channel bars wherein galvanized zinc and other types of finishes are required.

Figure 20:
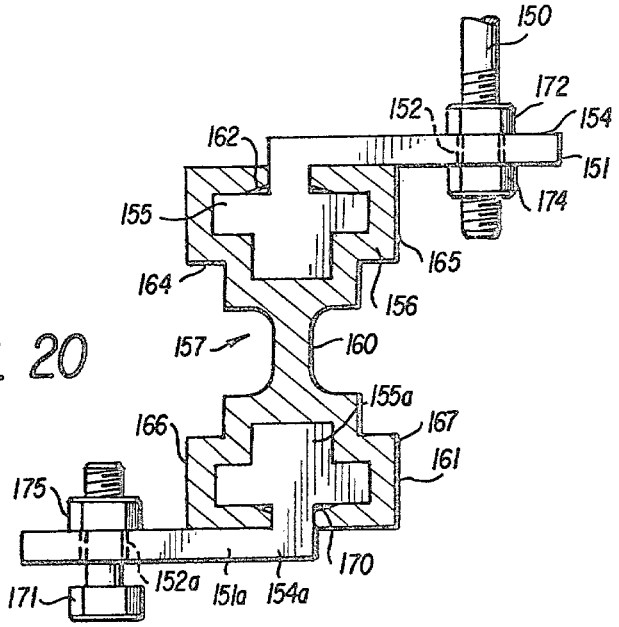
FIG. 20 is a cross-sectional view taken on lines 20—20 in FIG. 19.

In practice, practical dimensions for struts 157 are: height—6.4 cm, width—3.8 cm, width of grooves—2.7 cm, width of access slots—0.7 cm, vertical dimensions of grooves (including the access slots)—2 cm. The relative dimensions of the components as shown in cross-section in FIG. 20 are approximately correct. Using the components disclosed as arranged in FIG. 21, a load of ten pounds per square foot can be supported over the entire stage area and a concentrated load of 250 pounds can be supported at any place along struts 157.

Structural members above the ceiling are, in most modern buildings, a series of parallel trusses which are spaced-apart, generally equal distances. Frequently such trusses manufactured in a factory are made of steel chords and diaphragms which are welded together. These trusses are often then delivered by a flat bed trailer tractor to the building site wherein they are mounted on columns or posts of the building by a derrick or crane.

A typical joist or truss consists of a pair of upper and a pair of lower angle-irons which are welded together in a parallel relationship to a plurality of inclined bars to form, between the upper and lower parallel angle-irons, a zig-zag pattern. Alternatively, the trusses may be manufactured at the building site. Such trusses are more costly than factory manufactured trusses for the same purpose.

Figure 23:
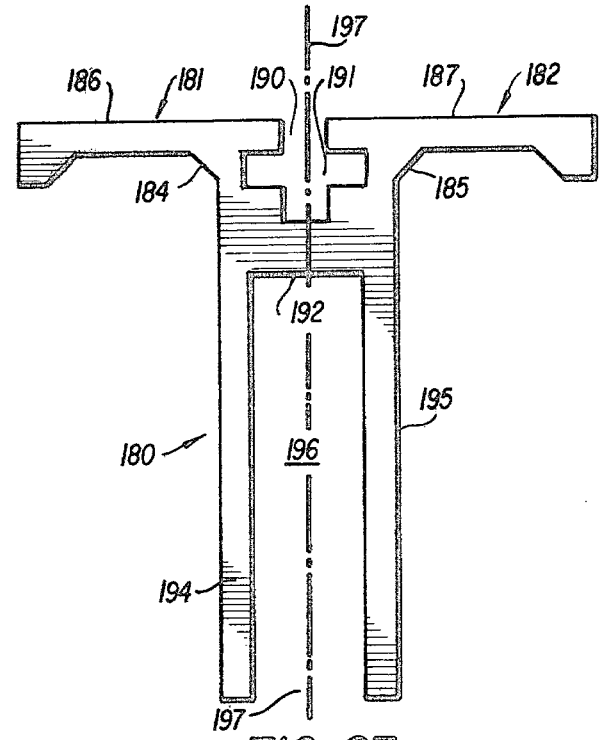
FIG. 23 is an elevational end view of an upper truss chord in accordance with the invention.
Figure 24:
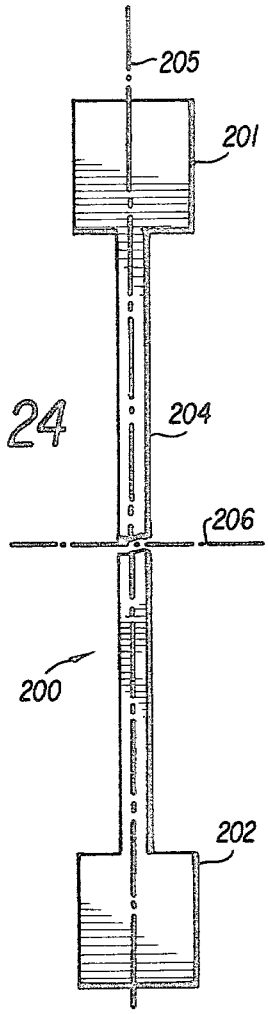
FIG. 24 is a cross-plan view of a diaphragm of the truss assembly in accordance with the invention.
Figure 25:
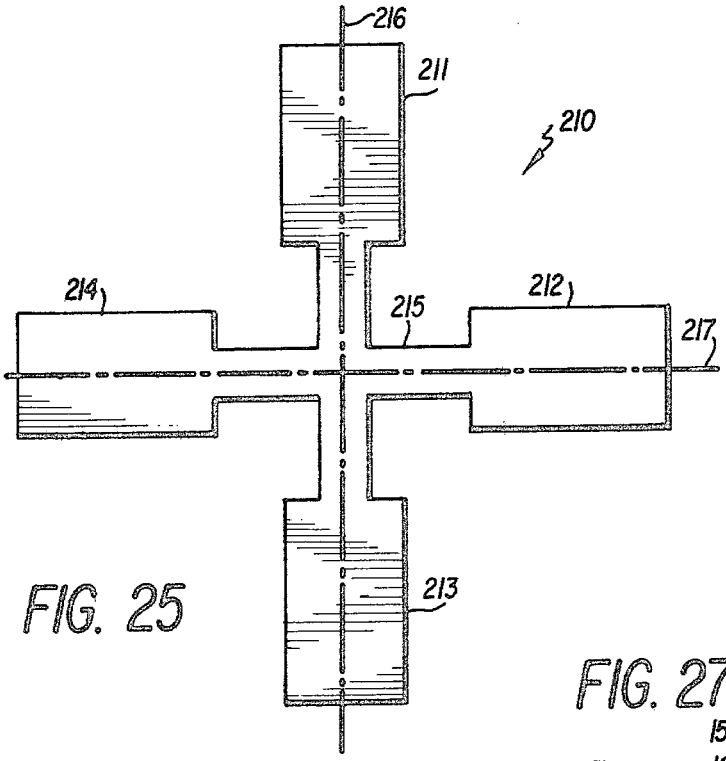
FIG. 25 is a plan of a column utilized for supporting the truss assembly in accordance with the invention.

Structural parts for a joist or truss, including supporting columns, which are well-adapted for suspending curtain rods, partitions and the like are disclosed herein with particular reference to FIGS. 23 through 27. FIGS. 23, 24 and 25 are end views of aluminum extrusions for chords, diaphragms and columns, respectively, for assembling the trusses, and supports for same, in a variety of embodiments.

In FIG. 23, a chord 180 has two spaced-apart arms 181 and 182 which include an upwardly extending arm part 184 in arm 181 and a further upwardly extending arm part 185 in arm 182. Also, it will be seen that arm 181 includes a horizontal arm part 186 which extends both outwardly and inwardly. Arm 182 includes a further similar horizontal arm part 187. Horizontal arm parts 186 and 187 define between them a slot 190 and the inboard edges of arm parts 186 and 187 together with the interior surfaces of arm parts 184 and 185 define a groove 191 having a vertical cross-section configuration substantially of an upright "T." The inward portions of arm parts 184 and 185 join with a horizontal connection part 192 which, in cross-section, has generally a square "U" configuration. Depending from each side of connection part 192 are a pair of parallel vertically disposed plates 194 and 195 which are aligned with arm parts 184 and 185 respectively. It will be appreciated from FIG. 23 that chord 180, which is situated as an upper chord as shown in FIG. 26, comprises, in effect, a pair of back-to-back generally "L" configured members joined by connection part 192 with slot 190 and groove 191 defined above it and an elongated notch 196 below it between the parallel plates 194 and 195.

A diaphragm 200 is shown in cross-section in FIG. 24 and comprises a pair of rectangular peripheral bar members 201 and 202 joined by an intermediate coplanar web 204.

The post or column 210 shown in cross-section in FIG. 25 comprises four rectangular bar portions 211, 212, 213 and 214 which are joined by a cross-shaped part 215. It will be noted in FIG. 25 that centerlines of symmetry, which are at right angles to each other, 216 and 217, divide column 210 into four identical parts. In FIG. 24, similar centerlines of symmetry 205 and 206 each divide the diaphragm 200 in two identical parts. However, considering that centerlines 205 and 206 divide diaphragm 200 into four parts, it will be seen that one pair of same are, in FIG. 24, mirror images of the other pair. In FIG. 23, there is only one centerline of symmetry 197 which divides chord 180 into two parts which are mirror images in relation to one another. The symmetry thus provided for the various components is helpful inasmuch as the greater the symmetry, the more difficult it is to place a component by mistake in an incorrect position.

FIG. 26 illustrates the components of the assembled truss, chord 180 and diaphragm 200. Further, column 210 cooperates as a part of the assemblage to support truss 220. Lower chord **180*a* is identical to chord 180 except that it has been notched as indicated by dotted lines at notch 221 to receive bar portion 212 of column 210. Chords 180 and 180*a* are connected to column 210 by means of three-quarter inch cadmium plated bolts 222 and corresponding nuts. Bolts 222 are received through openings drilled in plates 195 and 196 and matching aligned apertures in column 210**.

Chords 180 and **180*a* are similarly bolted through aligned openings in vertical plates 195 and 196 to chords 200 having further aligned openings through bar members 201 and 202 by three-eight cadmium plated bolts 224 with corresponding nuts. The vertical centerlines 207 of diaphragms 200** are spaced as required by the anticipated loading.

As shown in FIG. 27, chord **180*a* has an opening 188 in horizontal part 186 which receives the upper end of hanger 150 and a truss connecting support member 151*d* has a cruciform-shaped portion 155*d* which is received in the space comprising slot 190 and groove 191. Opening 152*d* provided in support member 191*d* receives hanger 150. It will be understood that support member 151*d* is retained firmly in position relative to horizontal part 186 by a pair of nuts consisting of nut 179 which bears against the upper surface horizontal part 186 and nut 189 which is tightened firmly against the lower surface of flange part 154*d* of support member 151*d*. Support member 151*d* strengthens the adjacent chord and, inasmuch as it is an extruded part, it can, if desired, in a more lengthy version be used along horizontal part 186 or 187 for a considerable distance, the entire distance between columns 210 if desired, and be bolted rigidly to part 186** at intervals as required for the anticipated loading.

The assembly of a truss, as shown in FIG. 26 connected to a column, is advantageous in that the components of the invention can be assembled in the field by hand wherein the only tools needed are a portable band saw and a portable electric drill with a rule to measure. Further, it can be erected and assembled in place one component at a time. If at the factory prior to assembly, the components are cut into the desired lengths, the only tool needed at the site is a power drill. Also, it will be noted, insofar as the connection to column 210 is concerned, not only are chords 180 and **180*a* connected thereto by bolts 222 and corresponding nuts but also chord 180 has its horizontal connection part 192 resting on the top edge of bar portion 212. This has the further advantage in that the upper chord 180 may be so supported in position, if desired, when the openings for the bolts 222** are drilled.

The upper chord 180 or the lower chord **180*a* or both may be inclined by biased cutting of the diaphragms 200. Such is shown in FIG. 28 wherein the upper chord 180 is thereby biased to form the truss for a gable roof. In FIG. 29, a truss 220*b* is shown wherein the diaphragms 200 have been biased on both the top and the bottom. Such roof can be raised handily. However, it is usually advantageous that the cutting to shape of diaphragms 200**, in such situations, be accomplished earlier in a factory.

As with previous embodiments, relative dimensions of the components as shown in cross-section in FIGS. 23–25 and 27 are approximately correct. Thus, the overall height of the chords 180 and 181 is about 12.8 centimeters and the overall width is the same. The thickness of parts 186 and 187 other than at their outer ends and also the thickness of plates 195 and 196, are 0.65 centimeters. The thickness of horizontal connection part 192 is about one centimeter. Bar members 201 and 202 are rectangular, 2.9 centimeters by 2.6 centimeters and the web has a uniformed thickness of 0.65 centimeters. The overall width of the diaphragm 200 between the ends of bar members 201 and 202 is about 23.4 centimeters. For the column 210, the bar portions 211–214 are rectangular as seen in the Figures with dimensions of 4.5 centimeters by 2.6 centimeters and the width overall along centerlines 216 and 217 is 14.8 centimeters. The cross-shaped portion 215 has in each its legs, an inmboard thickness of one centimeter. As with the other components described in this invention, size is important to the cost of the manufacture as well as to the strength and weight of the components.

Chords 180 and **180*a*, diaphragm 200 and column 210** as well as other extruded aluminum parts disclosed in this application, are preferably made of an aluminum alloy designated Alloy No. 6061-T6.

Although the preferred embodiments of the invention are described above, it is to be understood that the invention includes other adaptations and modifications within the scope of the appended claims which should be construed to cover corresponding structure described in this specification and equivalents thereof.

Having thus described my invention, what I claim as new and desire to secure by Letters Patent of the United States is:

1. A horizontal truss which comprises: a centrally vertically disposed portion including a plurality of diaphrams; an upper chord portion having two spaced-apart arms extending upwardly and outwardly from the upper aspect to said central portion and which define between them an upper groove, two spaced-apart vertically disposed plates respectively connected to said arms; a cross-member connecting said plates immediately under said groove and defining together with said plates a lower notch; a lower chord portion which is substantially identical in structure to said upper chord portion except that it is inverted whereby each said notch in each said chord portion faces the other and receives said plurality of diaphrams, fastening means received through said plates and said diaphrams rigidly connecting each of said diaphrams to said upper chord portion and to said lower chord portion; a supporting column having four legs defining a cruciform-configuration in cross-section for supporting the truss, one of said legs being received between and rigidly fastened to said vertically disposed plates of said upper chord and of said lower chord, the upper edge of one leg having said crossmember connecting said plates resting thereon, said upper edge of said one leg being connected to said plates by further of said fastening means received therethrough.

2. A truss in accordance with claim 1 wherein a truss connecting support member is provided which has a cruciform-shaped portion received in said lower groove, means included on said truss connecting support member for supporting, at least in part, a hanger rod.

3. A truss in accordance with claim 2 wherein a first strut support member is provided having a further cruciform-shaped portion and means for receiving said hanger rod, said first strut support member depending from said hanger rod.

4. A truss in accordance with claim 1 wherein said chord portions are composed of extruded structural aluminum.

5. A truss in accordance with claim 1 wherein links of a link chain are received in a supporting engagement in said lower groove of said lower chord.

6. A structure in accordance with claim 1, where each of said four legs of said supporting column are identical and comprise outward bar portions having identical rectangular configurations wherein the sides are substantially longer than the outer edges thereof and wherein the inner portions of said legs are substantially less thick than said bar portions.

7. A structure in accordance with claim 1 wherein each said diaphragm comprises a vertical plate having bar members along its outer vertical sides and a web between said bar members, said fastening means being received through said bar members.

8. A horizontal truss which comprises: an upper chord; a lower chord and a diaphram rigidly connected between said chords including a framework of a plurality of upstanding bars; a portion of said upper chord having two spaced-apart arms extending upwardly and outwardly from the upper aspect of said central portion and which define between them an upper groove, said groove having a vertical cross-section configuration substantially of an upright "T," the upper ends of said arms extending outwardly and inwardly and defining between their inboard edges a slot providing access centrally into said groove for receipt therein of overhead structure; and said upper chord comprising a lower chord portion having two further spaced-apart arms extending downwardly and outwardly from the lower aspect of said central portion which define between them a lower groove, said lower groove having a vertical cross-section configuration of an inverted "T," the lower ends of said further arms extending both outwardly and inwardly and defining between ther inboard edges a further slot giving access centrally into said lower groove for supporting underlying structure; a truss-connecting support member which has a cruciform-shape portion received in said lower groove, means included on said truss-connecting support member for supporting, at least in part, a hanger rod; a strut support member having further cruciform-shape portion and means for receiving said hanger rod, said strut support member depending from said hanger rod.

9. A truss in accordance with claim 8 wherein said framework bars are composed of extruded structural aluminum.

10. A horizontal truss comprising: a centrally vertically disposed portion including a framework of bars; an upper chord portion having two spaced-apart arms extending upwardly and outwardly from the upper aspect of said central portion and which define between them an upper groove, said groove having a vertical cross-section configuration substantially of an upright "T," the upper ends of said arms extending both outwardly and inwardly and defining between their inboard edges a slot providing access centrally into said groove for receipt therein of overhead structure; a lower chord portion having two further spaced-apart arms extending downwardly and outwardly from the lower aspect of said central portion which define between them a lower groove, said lower groove having a vertical cross-section configuration of an inverted "T," the lower ends of said further arms extending both outwardly and inwardly and defining between their inboard edges a further slot giving access centrally into said lower groove for supporting underlying structure; said upper chord and said lower chord each comprising a spaced-apart pair of vertically disposed plates and a "U" shaped member connecting said plates opposite said arms relative to said groove which defines facing aspects of said chords, said bars received between and rigidly secured to said plates of both said chords, said plates and corresponding said arms including the upper ends thereof containing throughout respective parallel planes; supporting columns having four legs defining a cruciform configuration in cross-section for supporting the truss, one of said legs being received between and rigidly connected to said vertically disposed plates, said "U" shaped member of said upper chord resting on the upper edge of said one leg.

11. A truss in accordance with claim 10 wherein said diaphragms are connected to said chords solely by separate fastening means extending therethrough.

* * * * *